US011041504B2

(12) United States Patent
Tokuyama

(10) Patent No.: US 11,041,504 B2
(45) Date of Patent: Jun. 22, 2021

(54) ROTOR OF CENTRIFUGAL COMPRESSOR, CENTRIFUGAL COMPRESSOR, AND METHOD FOR MANUFACTURING ROTOR OF CENTRIFUGAL COMPRESSOR

(71) Applicant: MITSUBISHI HEAVY INDUSTRIES COMPRESSOR CORPORATION, Tokyo (JP)

(72) Inventor: Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 172 days.

(21) Appl. No.: 15/765,647

(22) PCT Filed: Dec. 3, 2015

(86) PCT No.: PCT/JP2015/083976
§ 371 (c)(1),
(2) Date: Apr. 3, 2018

(87) PCT Pub. No.: WO2017/094159
PCT Pub. Date: Jun. 8, 2017

(65) Prior Publication Data
US 2019/0078582 A1 Mar. 14, 2019

(51) Int. Cl.
*F04D 29/28* (2006.01)
*F04D 29/26* (2006.01)
(Continued)

(52) U.S. Cl.
CPC ..... *F04D 29/284* (2013.01); *F04D 17/122* (2013.01); *F04D 29/266* (2013.01);
(Continued)

(58) Field of Classification Search
CPC ..... F04D 29/04; F04D 29/05; F04D 29/20; F04D 29/2222; F04D 29/266;F04D 29/60; F04D 29/62; F04D 29/624;
(Continued)

(56) References Cited

U.S. PATENT DOCUMENTS 2,420,921 A * 5/1947 Waldes ..... F16B 21/16 411/519
2,526,751 A 10/1950 Hornschuch
(Continued)

FOREIGN PATENT DOCUMENTS

GB 2179120 A 2/1987
JP S60-194101 U 12/1985
(Continued)

OTHER PUBLICATIONS

International Search Report for corresponding International Application No. PCT/JP2015/083976, dated Feb. 9, 2016 (4 pages).
(Continued)

*Primary Examiner* — Brian P Wolcott
*Assistant Examiner* — Justin A Pruitt
(74) *Attorney, Agent, or Firm* — Osha Bergman Watanabe & Burton LLP

(57) ABSTRACT

A rotor for a centrifugal compressor includes: a rotor main; an impeller; and a contact member. The rotor main body extends in an axis direction and includes a recessed part that is disposed on an outer circumferential surface. The impeller includes: a cylinder part having a cylindrical shape that extends around the axis direction and includes an inner circumferential surface with a fitting region tightly fitted to the outer circumferential surface of the rotor main body; an annular disc that extends from the cylinder part to a radial outer side with respect to the axis direction; a plurality of blades disposed at intervals in a circumferential direction on a surface facing one side in the axis direction of the annular
(Continued)

disc; and a cover that covers the plurality of blades from the one side in the axis direction. The contact member is fitted into the recessed part.

7 Claims, 6 Drawing Sheets

(51) Int. Cl.
*F04D 17/12* (2006.01)
*F04D 29/42* (2006.01)

(52) U.S. Cl.
CPC .... *F04D 29/4206* (2013.01); *F05B 2240/301* (2013.01); *F05B 2260/30* (2013.01); *F05D 2260/36* (2013.01); *F05D 2260/38* (2013.01)

(58) Field of Classification Search
CPC .. F04D 29/28; F04D 29/284; F04D 29/4206; F04D 17/10; F04D 17/12; F04D 17/122; F16B 21/16; F16B 21/18; F05B 2240/301; F05B 2260/30; F16D 1/06; F16D 1/08; F16D 1/0805; F16D 1/0829; F16D 1/0835; F16D 1/0841; F16D 1/0852; F16D 1/0858; F16D 1/087; F16D 1/0894; F16D 1/116
USPC ..... 418/186 R; 416/204 R
See application file for complete search history.

(56) References Cited

U.S. PATENT DOCUMENTS

| | | | | |
|---|---|---|---|---|
| 3,722,374 | A * | 3/1973 | Densmore | F16B 21/18 92/128 |
| 7,018,177 | B2 | 3/2006 | Feher | |
| 9,347,460 | B2 * | 5/2016 | Yagi | F04D 29/20 |
| 2005/0214125 | A1 * | 9/2005 | Feher | F04D 1/063 416/244 R |

FOREIGN PATENT DOCUMENTS

| | | | |
|---|---|---|---|
| JP | S63-26701 | U | 2/1988 |
| JP | 2003-065290 | A | 3/2003 |
| JP | 2005-291152 | A | 10/2005 |
| JP | 2009-228774 | A | 10/2009 |
| WO | 2014/197343 | A1 | 12/2014 |

OTHER PUBLICATIONS

Written Opinion for corresponding International Application No. PCT/JP2015/083976, dated Feb. 2, 2016 (11 pages).
Written Opinion for corresponding International Application No. PCT/JP2015/083976, dated Feb. 9, 2016 (11 pages).

* cited by examiner

ROTOR OF CENTRIFUGAL COMPRESSOR, CENTRIFUGAL COMPRESSOR, AND METHOD FOR MANUFACTURING ROTOR OF CENTRIFUGAL COMPRESSOR

TECHNICAL FIELD

The present invention relates to a rotor of a centrifugal compressor, a centrifugal compressor, and a method of manufacturing a rotor of a centrifugal compressor.

BACKGROUND

Generally, a rotary machine such as a centrifugal compressor includes a rotor which is rotationally driven and a casing which covers the rotor from an outer circumferential side to form a flow path inside. A rotor includes a rotating shaft extending along a rotation axis and an impeller installed on an outer circumferential surface of the rotating shaft.

In installing an impeller on a rotating shaft, it is common to perform tight fitting by shrink fitting or cold fitting as described in Patent Literature 1 below, for example.

PATENT LITERATURE

Patent Literature 1

Japanese Unexamined Utility Model Application, First Publication No. S63-26701

Incidentally, in a compressor with a relatively high compression ratio, it is particularly necessary to rotate the rotor at a high speed. When a rotor is rotated at a high speed, a centrifugal force from a radial inner side with respect to a rotating shaft toward the outside is applied to the impeller. Such a centrifugal force may cause the impeller to rise upward from an outer circumferential surface of the rotating shaft toward a radial outer side.

Further, a thrust force is also applied to the impeller along the rotating shaft from a high pressure side toward a low pressure side. Such a thrust force also increases in proportion to an increase in compression ratio.

In order to resist the thrust force while suppressing the rising up of the impeller, it is also conceivable to increase a tightening margin when performing the tight fitting as described above. However, when the tightening margin is large, slight bending may occur in the rotor due to a high tightening force, which may induce vibrations during operation. In addition, since it takes time and labor for installing and removing the impeller, there is a likelihood of manufacturing costs and maintenance costs increasing.

SUMMARY

One or more embodiments of the present invention provide a rotor of a centrifugal compressor which can be easily assembled, a method of manufacturing the same, and a centrifugal compressor which can be stably operated under a relatively high compression ratio.

A rotor of a centrifugal compressor according to one or more embodiments of the present invention includes a rotor main body extending in an axis direction and having a recessed part formed on an outer circumferential surface thereof, an impeller including a cylinder part having a cylindrical shape extending around the axis and in which an inner circumferential surface having a fitting region tightly fitted to the outer circumferential surface of the rotor main body is formed, an annular disc extending from the cylinder part to a radial outer side with respect to the axis, a plurality of blades provided at intervals in a circumferential direction on a surface facing one side in the axis direction of the annular disc, and a cover covering the plurality of blades from the one side in the axis direction, and a contact member fitted into the recessed part and in which a part protrudes toward a radial outer side from the outer circumferential surface to come in contact with the cylinder part from the axis direction.

According to one or more embodiments, a part of the contact member protruding toward a radial outer side from the outer circumferential surface of the rotor main body comes in contact with the cylinder part of the impeller from the axis direction. That is, a thrust force applied to the impeller can be received by the contact member. Further, a size of the fitting region and a magnitude of a tightening margin can be reduced to be small as compared with a case in which the contact member is not provided. Thereby, a likelihood of occurrence of vibration in the centrifugal compressor can be reduced.

According to one or more embodiments of the present invention, in the rotor of a centrifugal compressor according to the first aspect, the cylinder part may include a first cylinder part disposed on the one side in the axis direction and a second cylinder part disposed on the other side of the first cylinder part in the axis direction with a clearance therebetween in the axis direction with respect to the first cylinder part, a stepped part recessed to the radial outer side may be formed in a region of the inner circumferential surface of the first cylinder part including an end part on the other side in the axis direction, an end surface on the one side in the axis direction of the stepped part may come in contact with the contact member from the one side in the axis direction, and an end surface on the one side in the axis direction of the second cylinder part may come in contact with the contact member from the other side in the axis direction, and an end part on the radial inner side of the clearance may communicate with a region on the radial inner side of the stepped part.

According to one or more embodiments, the thrust force applied to the impeller can be received by the contact member. Further, since the cylinder part is divided into the first cylinder part and the second cylinder part with the clearance formed therebetween, a natural frequency of the impeller can be reduced to a low level.

On the other hand, when the above-described clearance is not provided, the natural frequency of the impeller increases due to an influence of the natural frequency of the split ring. Thereby, whirling vibration or the like may be generated in the rotor.

However, according to one or more embodiments, since increase in natural frequency can be suppressed by providing a clearance, a possibility of the whirling vibration or the like being generated can be reduced.

According to one or more embodiments of the present invention, in the rotor of a centrifugal compressor according to the first aspect, the contact member may come in contact with an end surface on the one side in the axis direction of the cylinder part from the one side in the axis direction.

According to one or more embodiments, the contact member comes in contact with the cylinder part from the one side in the axis direction. Thereby, even when a thrust force is applied to the cylinder part from the other side in the axis direction toward the one side, the thrust force can sufficiently be resisted. Further, a size of the fitting region and a magnitude of a tightening margin can be reduced to be small as compared with a case in which the contact member is not provided. Thereby, a likelihood of occurrence of vibration in the centrifugal compressor can be reduced.

According to one or more embodiments of the present invention, in the rotor of a centrifugal compressor according to any one of the first to third aspects, the inner circumferential surface of the cylinder part may include a non-fitting region adjacent to the fitting region in the axis direction and having an inner diameter larger than that of the rotor main body.

According to one or more embodiments, a fitting region and a non-fitting region are formed on the inner circumferential surface of the cylinder part. Thereby, a tightening force can be reduced to be small as compared with a case in which the fitting region is provided over the entire inner circumferential surface. Therefore, the impeller can be easily installed on and removed from the rotor main body.

According to one or more embodiments of the present invention, in the rotor of a centrifugal compressor according to any one of the first to fourth aspects, the contact member may include a plurality of segmented parts arranged in the circumferential direction with respect to the axis.

According to one or more embodiments, the contact member can be easily configured by sequentially installing a plurality of segmented parts on a recessed groove of the rotor main body from the outer circumferential side.

According to one or more embodiments of the present invention, a centrifugal compressor includes the rotor of a centrifugal compressor according to any one of claims 1 to 5 and a casing which covers the rotor from an outer circumferential side to form a flow path inside.

According to one or more embodiments, it is possible to obtain a centrifugal compressor having a high compression ratio and easy assemblability.

According to one or more embodiments of the present invention, a method of manufacturing the rotor of a centrifugal compressor according to any one of the first to fifth aspects includes a process of installing the cylinder part of the impeller on the rotor main body from the axis direction and forming the fitting region, and a process of installing the contact member on the recessed part of the rotor main body.

According to one or more embodiments, it is possible to easily obtain a rotor of a centrifugal compressor which can be stably operated under a high compression ratio.

According to one or more embodiments of the present invention, it is possible to provide a rotor of a centrifugal compressor which can be easily assembled, a method of manufacturing the same, and a centrifugal compressor which can be stably operated under a high compression ratio.

DETAILED DESCRIPTION

Figure 1:
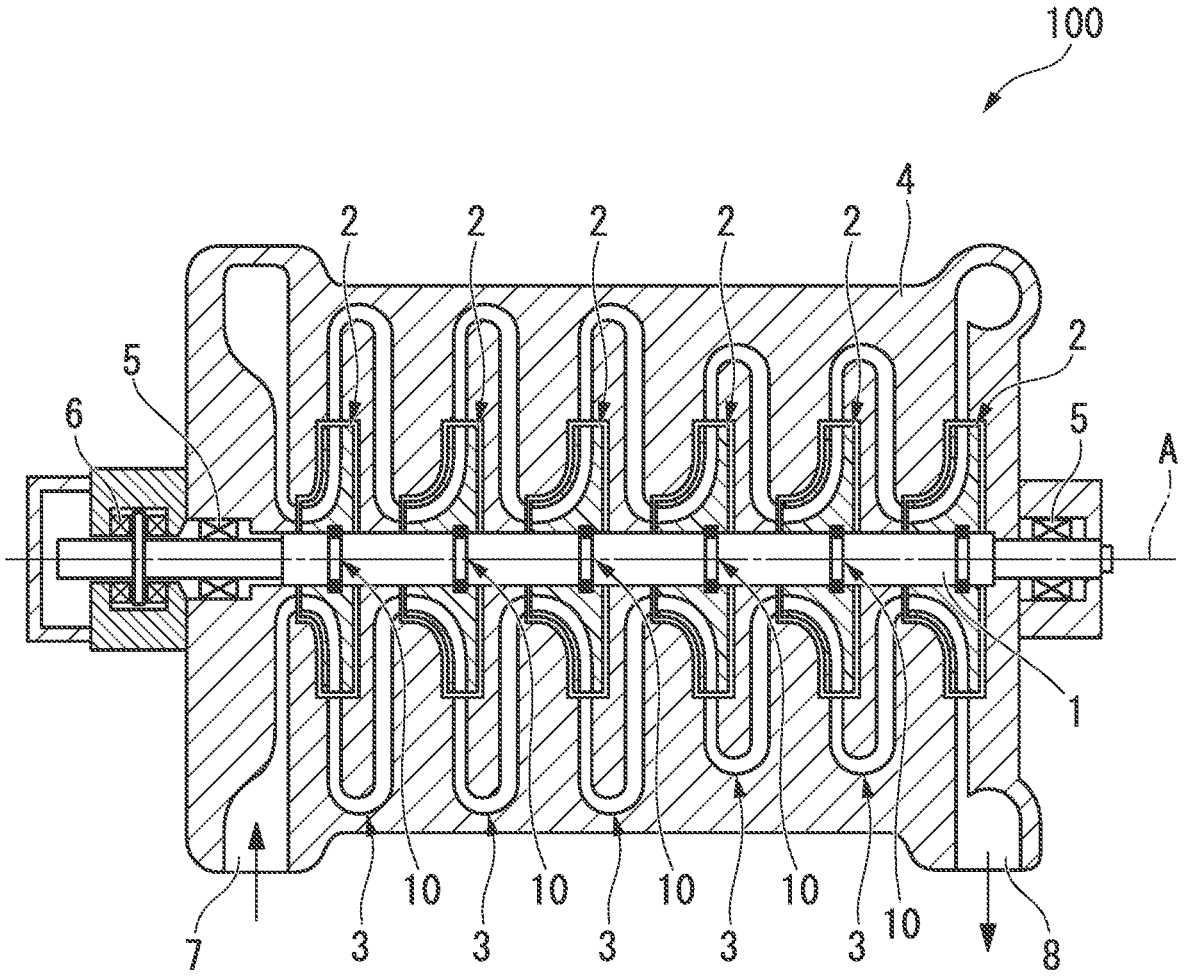
FIG. 1 is a view illustrating a configuration of a centrifugal compressor according to one or more embodiments of the present invention.

Hereinafter, embodiments of the present invention will be described with reference to the drawings. As illustrated in FIG. 1, a centrifugal compressor 100 (rotary machine) according to one or more embodiments includes a rotor 1 having a plurality (six) of impellers 2 and a casing 4 which covers the rotor 1 from an outer circumferential side to form a flow path 3.

The casing 4 has a cylindrical shape extending substantially along an axis A. The rotor 1 extends to pass through an inside of this casing 4 along the axis A. A journal bearing 5 and a thrust bearing 6 are provided at opposite end parts of the casing 4 in an axis A direction. The rotor 1 is rotatably supported around the axis A by the journal bearing 5 and the thrust bearing 6.

An intake port 7 for taking in a fluid from outside is provided on one side in the axis A direction of the casing 4. Further, a discharge port 8 through which a fluid compressed inside the casing 4 is discharged is provided on the other side in the axis A direction of the casing 4. That is, the centrifugal compressor 100 employs a method in which a fluid flows from one side in the axis A direction to the other side (straight type).

Inside the casing 4, an internal space through which the intake port 7 and the discharge port 8 communicate with each other and in which diameter reduction and expansion are repeated is formed. This internal space accommodates the plurality of impellers 2 and forms a part of the flow path 3.

Figure 2:
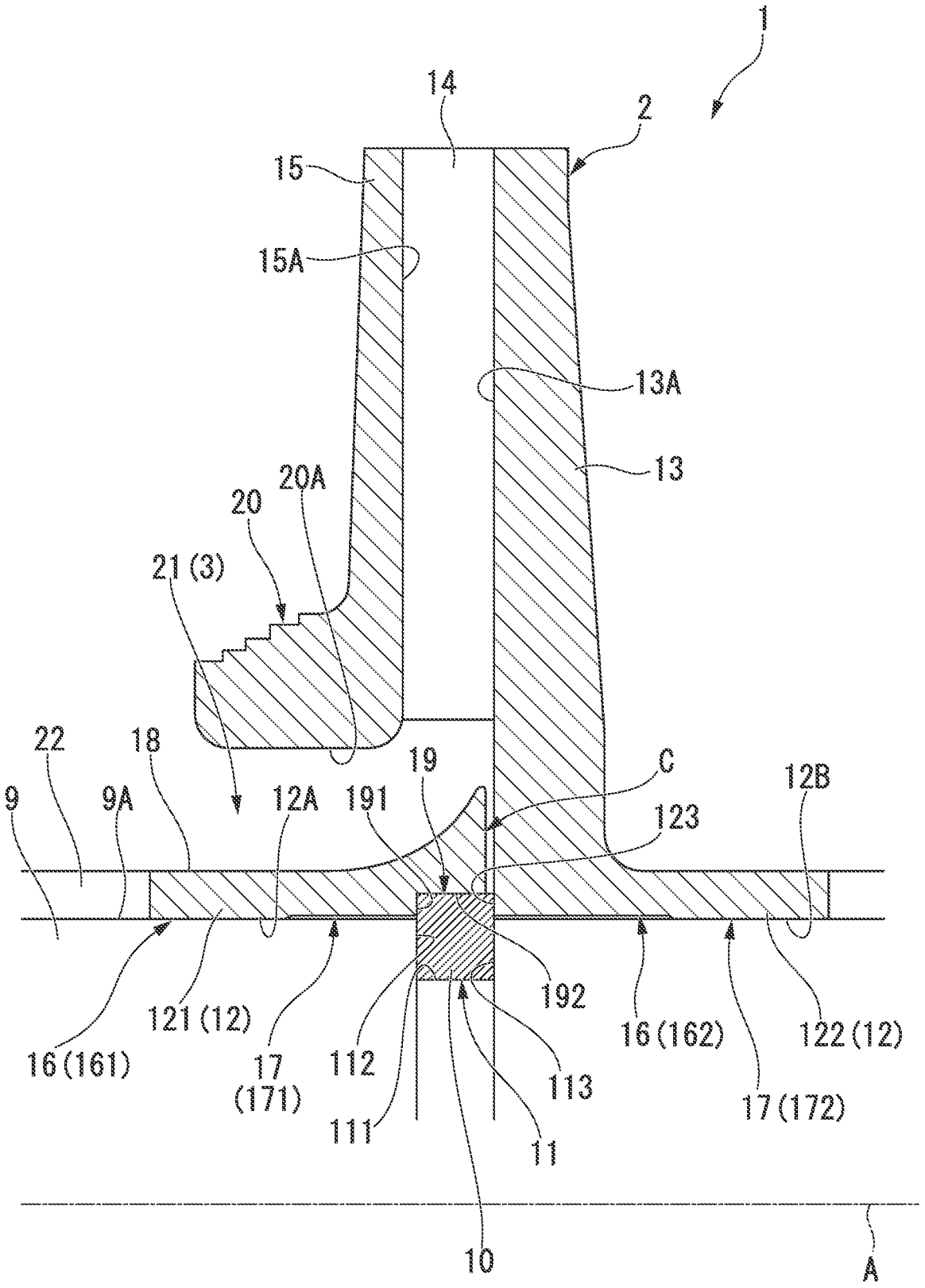
FIG. 2 is a view illustrating a configuration of a rotor according to one or more embodiments of the present invention.

As illustrated in FIG. 2, the rotor 1 includes a substantially rod-shaped rotor main body 9 extending in the axis A direction, the plurality of impellers 2 provided at intervals in the axis A direction on an outer circumferential surface 9A of the rotor main body 9, and a split ring 10 (a contact member) which is in contact with the rotor main body 9 and each of the impellers 2. In one or more embodiments, since all of the plurality of impellers 2 provided in the rotor main body 9 have the same configuration, only one impeller 2 will be representatively illustrated and described.

An angular groove shaped recessed part 11 recessed from a radial outer side toward an inner side with respect to the axis A is formed on the outer circumferential surface 9A of the rotor main body 9. A surface on a radial inner side of the recessed part 11 is a recessed part bottom surface 111. A surface on one side in the axis A direction of the recessed part 11 is a recessed part first end surface 112 extending in a direction substantially perpendicular to the recessed part bottom surface 111 (that is, a radial direction with respect to the axis A). A surface on the other side in the axis A direction of the recessed part 11 is a recessed part second end surface 113 extending substantially parallel to the recessed part first end surface 112.

The split ring 10 to be described below is installed on this recessed part 11. On opposite sides in the axis A direction with the recessed part 11 interposed therebetween, outer diameters of the rotor main body 9 are substantially the same as each other. Further, a dimension in the radial direction (depth) of the recessed part 11 is smaller than a dimension in the radial direction of the split ring 10. Thus, a part of the radial outer side of the split ring 10 protrudes toward the radial outer side from the recessed part 11.

The impeller 2 includes a tubular cylinder part 12 extending around the axis A, an annular disc 13 integrally formed with the cylinder part 12 and extending from the cylinder part 12 toward the radial outer side with respect to the axis A, a plurality of blades 14 provided on a surface on one side in the axis A direction of the annular disc 13, and a cover 15 covering the blades 14 from one side in the axis A direction.

The cylinder part 12 includes a first cylinder part 121 disposed on one side in the axis A direction and a second cylinder part 122 disposed at a distance from the first cylinder part 121 on the other side in the axis A direction.

An inner circumferential surface 12A of the first cylinder part 121 has a circular cross section centered on the axis A when viewed from the axis A direction. Further, only a part of the inner circumferential surface 12A including an end part on one side in the axis A direction is a fitting region 16 (a first fitting region 161) which is fixed to the outer circumferential surface 9A of the rotor main body 9 from the radial outer side by tight fitting. That is, in a state in which the impeller 2 is installed on the rotor main body 9, the outer circumferential surface 9A of the rotor main body 9 and the inner circumferential surface 12A of the first cylinder part 121 are in contact with each other without a clearance therebetween in the first fitting region 161.

As an example, the fitting region 16 is formed by shrink fitting. That is, at a stage before applying shrink fitting, an outer diameter of the rotor main body 9 is set to be larger than an inner diameter of the cylinder part 12. A difference between the outer diameter of this rotor main body 9 and the inner diameter of the cylinder part 12 serves as a tightening margin when shrink fitting is applied. In one or more embodiments, a tightening ratio is set to 0.5/1000 or more and 8.0/1000 or less.

In one or more embodiments, the tightening ratio is set to 1.0/1000 or more and 5.0/1000 or less. In one or more embodiments, the tightening ratio is set to 1.5/1000 or more and 3.0/1000 or less.

The tightening ratio referred to here represents an index indicating a relative magnitude of the tightening margin with respect to a design reference dimension of the rotor main body 9. Specifically, when a reference dimension of the outer shape of the rotor main body 9 is assumed to be 1000 and a magnitude of the tightening margin is assumed to be X, the tightening ratio is expressed as X/1000.

In such a configuration, when the impeller 2 (the cylinder part 12) is heated and thermally expands, the inner diameter of the cylinder part 12 is enlarged and becomes larger than the outer diameter of the rotor main body 9. In a state in which the inner diameter of the cylinder part 12 is enlarged, the rotor main body 9 is inserted inside the cylinder part 12. Thereafter, when the heat applied to the impeller 2 is removed, the impeller 2 contracts and returns to an initial dimension. That is, in the above-described fitting region 16, the cylinder part 12 is tightly fitted to the rotor main body 9.

On the inner circumferential surface 12A of the first cylinder part 121, a region on the other side in the axis A direction adjacent to the fitting region 16 is a non-fitting region 17 (a first non-fitting region 171) which is not subjected to such tight fitting as described above. That is, in the first non-fitting region 171, the inner diameter of the cylinder part 12 is slightly larger than the outer diameter of the rotor main body 9. Thus, in a state in which the impeller 2 is installed on the rotor main body 9, the first cylinder part 121 is fitted to the rotor main body 9 with a clearance therebetween in the first non-fitting region 171.

On a cross section including the axis A, a surface on an outer circumferential side of the first cylinder part 121 gradually curves from the radial inner side with respect to the axis A toward the outer side from one side in the axis A direction toward the other side. In other words, the surface on the outer circumferential side of the first cylinder part 121 is formed in a substantially conical shape. This surface serves as a flow path forming surface 18 which forms a part of the above-described flow path 3.

A stepped part 19 recessed from the radial inner side to the outer side with respect to the axis A is formed in a region of the inner circumferential surface 12A of the first cylinder part 121 including an end part on the other side in the axis A direction. More specifically, this stepped part 19 has a first end surface 191 which forms a wall surface on one side in the axis A direction and an annular bottom surface 192 substantially perpendicular to the first end surface 191 and extending in a circumferential direction of the axis A formed therein. In a cross-sectional view including the axis A, the first end surface 191 and a second end surface extend in the radial direction with respect to the axis A. The bottom surface 192 extends along the axis A.

The second cylinder part 122 is provided at a distance (clearance C) from the above-described first cylinder part 121 on the other side in the axis A direction. This second cylinder part 122 is formed integrally with the annular disc 13 to be described below. An inner circumferential surface 12B of the second cylinder part 122 is in contact with the outer circumferential surface 9A of the rotor main body 9 from the radial outer side in a region on the other side in the axis A direction with respect to the above-described recessed part 11 on the rotor main body 9. An end surface on one side in the axis A direction of the second cylinder part 122 (a second cylinder part end surface 123) faces inside the stepped part 19 from the other side in the axis A direction.

An end surface on the other side in the axis A direction of the first cylinder part 121 faces the annular disc 13 via the clearance C described above. That is, an outer circumferential side of the cylinder part 12 and a radial inner side region of the stepped part 19 communicate with each other via the clearance C.

The inner circumferential surface 12B of the second cylinder part 122 has a circular cross section centered on the axis A when viewed from the axis A direction. Further, as in the above-described first fitting region 161 and the first non-fitting region 171, a second fitting region 162 tightly fitted to the outer circumferential surface 9A of the rotor main body 9 and a second non-fitting region 172 adjacent to the second fitting region 162 are also formed on the inner circumferential surface 12B of the second cylinder part 122. Specifically, the second fitting region 162 is formed in a region of the inner circumferential surface 12B of the second cylinder part 122 including an end part on the other side in the axis A direction. The second non-fitting region 172 is an area on one side with respect to this second fitting region 162 in the axis A direction. As in the first non-fitting region 171, the second non-fitting region 172 is also fitted to the outer circumferential surface 9A of the rotor main body 9 with a clearance therebetween.

The annular disc 13 has an annular shape extending from the above-described second cylinder part 122 toward the radial outer side with respect to the axis A. The plurality of blades 14 are arranged at intervals in a circumferential direction with respect to the axis A on a surface facing one side in the axis A direction of the annular disc 13 (a first facing surface 13A). Each of the blades 14 is a wing-shaped member extending from the first facing surface 13A toward one side in the axis A direction.

Although not illustrated in detail, when viewed from the axis A direction, the blade 14 curves from the radial inner side toward the outer side from one side in a circumferential direction toward the other side. A space between a pair of adjacent blades 14 in the circumferential direction forms a part of the flow path 3 (an impeller flow path 21).

A cover 15 is installed on an end edge on one side in the direction of axis A of these blades 14. The cover 15 covers the plurality of blades 14 from one side in the axis A direction. Specifically, the cover 15 has an annular shape around the axis A. In opposite surfaces in the axis A direction of the cover 15, a surface facing the other side in the axis A direction (that is, a surface to which an end edge on one side in the axis A direction of the blade 14 is connected) is a second facing surface 15A facing the above-described first facing surface 13A in the axis A direction with the space between the adjacent blades 14 interposed therebetween.

On a radial inner side of the cover 15, a protruding part 20 protruding toward one side in the axis A direction is integrally provided. A surface on a radial inner side of this protruding part 20 is a cover facing surface 20A facing the flow path forming surface 18 of the first cylinder part 121 from the radial outer side with respect to the axis A.

A space through which a fluid flows is formed inside the impeller 2 by the above-described flow path forming surface 18, the cover facing surface 20A, the first facing surface 13A, and the second facing surface 15A. This space forms the impeller flow path 21 which is a part of the above-described flow path 3.

On one side in the axis A direction of the impeller 2, a sleeve 22 formed in a cylindrical shape around the axis A is installed. This sleeve 22 is in contact with the first cylinder part 121 from one side in the axis A direction. In one or more embodiments, an inner diameter and outer diameter of the sleeve 22 are substantially uniform throughout in the axis A direction. Further, an outer circumferential surface of the sleeve 22 and an outer circumferential surface of the first cylinder part 121 are continuous in the axis A direction.

Figure 3:
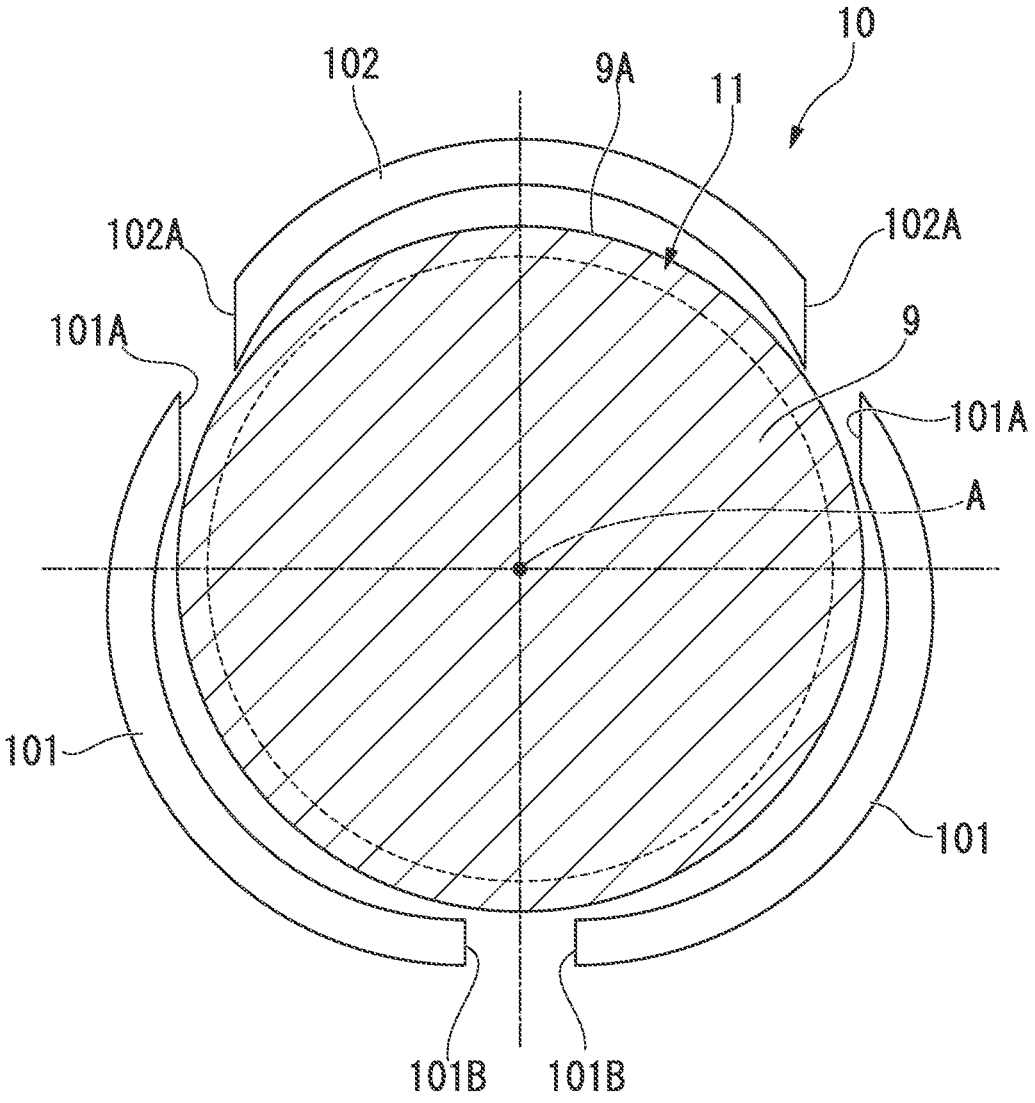
FIG. 3 is a view illustrating a configuration of a contact member (a split ring) according to one or more embodiments of the present invention.

The split ring 10 is an annular member disposed in a space surrounded by the recessed part 11 formed on the outer circumferential surface 9A of the rotor main body 9, the stepped part 19 formed on the inner circumferential surface 12A of the first cylinder part 121, and the end surface in the axis A direction of one side of the second cylinder part 122. In a cross-sectional view including the axis A, a cross-sectional shape of the split ring 10 is substantially rectangular. As illustrated in FIG. 3, the split ring 10 according to one or more embodiments is segmented into a plural number (three) in the circumferential direction with respect to the axis A. That is, the split ring 10 is formed of three segmented parts arranged in the circumferential direction.

More specifically, the segmented parts include a pair of first segmented parts 101 adjacent to each other in the circumferential direction and a second segmented part 102 surrounded on both circumferential sides by the pair of first segmented parts 101. The first segmented parts 101 and the second segmented part 102 are formed from an elastically deformable member having a substantially arc shape. Further, in a state before being installed on the rotor main body 9, each of the first segmented parts 101 and the second segmented part 102 has a larger curvature than that of the outer circumferential surface 9A of the rotor main body 9.

An end surface 101B on one side in a circumferential direction of each of the first segmented parts 101 extends substantially parallel to a radial direction with respect to its own central axis. On the other hand, an end surface on the other side in the circumferential direction of each of the first segmented parts 101 (a first inclined surface 101A) extends to be inclined with respect to the radial direction with respect to its own central axis. More specifically, this first inclined surface 101A is obliquely cut so as to face a radial inner side. That is, each of the first segmented parts 101 has a shape which is asymmetrical in the circumferential direction with reference to the radial direction with respect to its own central axis.

Unlike the first segmented parts 101, the second segmented part 102 has a shape symmetrical in the circumferential direction. Each of the end surfaces on both circumferential sides of the second segmented part 102 (a second inclined surface 102A) extends to be inclined with respect to the radial direction with respect to its own central axis. More specifically, the second inclined surface 102A is obliquely cut so as to face a radial outer side. The second inclined surface 102A is inclined with respect to the radial direction at substantially the same angle as the above-described first inclined surface 101A. In other words, in a state in which the first segmented parts 101 and the second segmented part 102 are assembled, the first inclined surface 101A and the second inclined surface 102A come into contact with each other substantially parallel to each other.

The two first segmented parts 101 and one second segmented part 102 as described above are fitted into the recessed part 11 of the rotor main body 9 from the radial outer side. In a state of being fitted into the recessed part 11, all of the first segmented parts 101 and the second segmented part 102 are elastically deformed in a direction in which curvatures become small. Further, in this state, the first inclined surface 101A of the first segmented parts 101 and the second inclined surface 102A of the second segmented part 102 are in contact with each other without a clearance therebetween. That is, the second inclined surface 102A facing substantially the radial inner side comes into contact with the first inclined surface 101A that faces substantially the radial outer side.

Here, since the second segmented part 102 is elastically deformed in a direction in which the curvature decreases as described above, a force that restores in a direction in which the curvature increases acts on the second segmented part 102 due to its own elastic restoring force. That is, in a state in which the split ring 10 is assembled, the second inclined surface 102A of the second segmented part 102 exerts a force to the first inclined surface 101A of the first segmented parts 101 from the radial outer side. Due to this force, the two first segmented parts 101 are undetachably accommodated in the recessed part 11 while they are elastically deformed in a direction in which the curvatures become smaller.

The split ring 10 is surrounded from both sides in the radial direction by the recessed part 11 of the rotor main body 9 and the stepped part 19 of the impeller 2. Specifically, as illustrated in FIG. 2, the recessed part first end surface 112 of the recessed part 11 and the first end surface 191 of the stepped part 19 are in contact with a surface on one side in the axis A direction of the split ring 10. The recessed part bottom surface 111 of the recessed part 11 is in contact with a surface on a radial inner side of the split ring 10. The bottom surface 192 of the stepped part 19 is in contact with a surface on the radial outer side of the split ring 10. The recessed part second end surface 113 of the recessed part 11 and the second cylinder part end surface 123 of the second cylinder part 122 are in contact with a surface on the other side in the axis A direction of the split ring 10.

Figure 4:
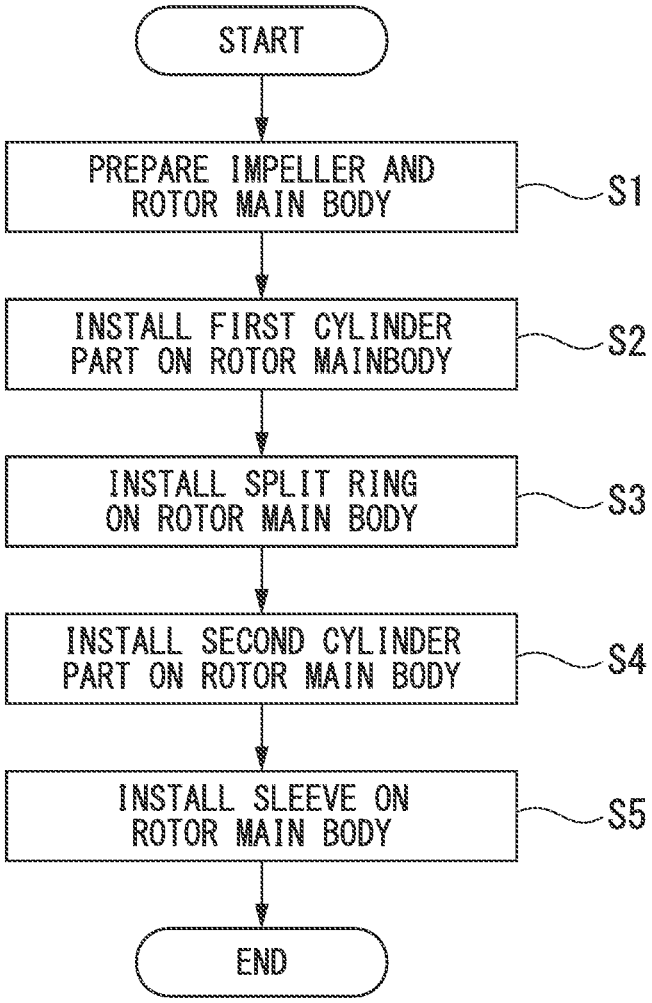
FIG. 4 is a process flow diagram illustrating a method of manufacturing the rotor according to one or more embodiments of the present invention.

Next, a method of manufacturing the rotor 1 of the centrifugal compressor 100 will be described with reference to FIG. 4. First, the impeller 2 and the rotor main body 9 configured as described above are prepared (process S1). In one or more embodiments, each of these members is integrally formed of a relatively hard metal material, for example, such as stainless steel.

Next, the impeller 2 is installed on the rotor main body 9. In installing the impeller 2 on the rotor main body 9, as an example, the first cylinder part 121 is first installed by shrink fitting. Through this process, the first fitting region 161 and the first non-fitting region 171 described above are formed (process S2).

Next, the split ring 10 (the first segmented parts 101 and the second segmented part 102) is installed on the recessed part 11 of the rotor main body 9 (process S3). After the split ring 10 is installed, the second cylinder part 122 is installed on the outer circumferential surface 9A of the rotor 1 (process S4). Through this process, the second cylinder part 122 and the annular disc 13 integrally formed with the second cylinder part 122 are installed on the rotor main body 9. Specifically, the surface on one side in the axis A direction of the second cylinder part 122 (that is, the second end surface of the stepped part 19) comes into contact with the surface on the other side in the axis A direction of the split ring 10.

Further, at this time, the above-described clearance C is formed between the first cylinder part 121 and the second cylinder part 122 in the axis A direction. Further, through this process, the second fitting region 162 and the second non-fitting region 172 described above are formed. Next, the sleeve 22 is installed on the rotor main body 9 (process S5). As described above, each process of the method of manufacturing the rotor 1 of the centrifugal compressor 100 according to one or more embodiments is thus completed.

Next, an operation of the centrifugal compressor 100 according to one or more embodiments will be described. In operating the centrifugal compressor 100, the rotor 1 is first rotated by a driving source (not illustrated). When the rotor 1 is rotationally driven around the axis A by a driving source (not illustrated), the plurality of impellers 2 provided on the rotor 1 rotate integrally with the rotor 1. As the impeller 2 rotates, an external fluid is introduced into the flow path 3 in the casing 4 from the intake port 7.

The fluid introduced from one side in the axis A direction through the flow path 3 as described above is compressed through the impeller flow path 21. More specifically, the fluid flows from one side in the axis A direction toward the other side through a space formed by the cover facing surface 20A and the flow path forming surface 18. Next, after a direction of the fluid is changed along a curved shape of the flow path forming surface 18, the fluid flows into the space formed by the first facing surface 13A and the second facing surface 15A from the radial inner side toward the outer side. In the same manner, the fluid is sequentially compressed through a plurality of impeller flow paths 21. The compressed high-pressure fluid is supplied to various external devices (not illustrated) through the discharge port 8.

Here, during the operation of the centrifugal compressor 100, a relatively low pressure fluid is flowing through one side in the axis A direction (the intake port 7 side) in the flow path 3 while a relatively high pressure fluid is flowing through the other side in the axis A direction (the discharge port 8 side). Due to this pressure difference, a force (a thrust force) directed from the other side in the axis A direction toward one side is applied to the impeller 2.

In addition, in a compressor with a high compression ratio, since it is particularly necessary to rotate the rotor 1 at a high speed, a centrifugal force from a radial inner side toward an outer side with respect to the rotating shaft is applied to the impeller 2. Due to such a centrifugal force, there may be a case that the impeller 2 rise upward from the outer circumferential surface 9A of the rotor main body 9 toward the radial outer side.

In order to resist the thrust force while suppressing rising up of the impeller 2, it is also conceivable to increase the tightening margin when performing the tight fitting as described above. However, when the tightening margin is large, slight bending may occur in the rotor 1 due to a high tightening force, which may induce vibrations during operation. In addition, since it takes time and labor for installing and removing the impeller 2, there is a likelihood of manufacturing costs and maintenance costs increased.

Therefore, in the centrifugal compressor 100 according to one or more embodiments, since some of the thrust force is received by the split ring 10, a size of the fitting region 16 and a magnitude of a tightening margin are reduced to be relatively small. More specifically, a part of the split ring 10 protruding toward the radial outer side from the outer circumferential surface 9A of the rotor main body 9 is in contact with the cylinder part 12 of the impeller 2 from the axis A direction. Specifically, the recessed part first end surface 112 of the recessed part 11 and the first end surface 191 of the stepped part 19 are in contact with the surface on one side in the axis A direction of the split ring 10. The recessed part bottom surface 111 of the recessed part 11 is in contact with the surface on the radial inner side of the split ring 10. The bottom surface 192 of the stepped part 19 is in contact with the surface on the radial outer side of the split ring 10. The recessed part second end surface 113 of the recessed part 11 and the second cylinder part end surface 123 of the second cylinder part 122 are in contact with the surface on the other side in the axis A direction of the split ring 10.

In this way, as the split ring 10 is provided on the outer circumferential surface 9A of the rotor main body 9 and is brought into contact with the impeller 2, it is possible to receive the thrust force applied to the impeller 2. That is, it is possible to reduce a force applied to the fitting region 16 by an amount corresponding to the thrust force received by the split ring 10. As a result, the size of the fitting region 16 can be reduced to be small as compared with a case in which the split ring 10 is not provided. In other words, the non-fitting region 17 can be formed on the outer circumferential surface 9A of the rotor main body 9. Further, a magnitude of a tightening margin in the fitting region 16 can also be reduced to be small. Thereby, a likelihood of occurrence of vibration in the centrifugal compressor 100 can be reduced to be small as compared with a case in which tight fitting is applied over the entire outer circumferential surface 9A of the rotor main body 9, and the impeller 2 can be easily installed on or removed from the rotor main body 9.

Further, since the cylinder part 12 is divided into the first cylinder part 121 and the second cylinder part 122 with the clearance C formed therebetween, a natural frequency of the impeller 2 can be reduced to a low level.

On the other hand, when the above-described clearance is not provided, the natural frequency of the impeller 2 increases due to an influence of the natural frequency of the split ring 10. Thereby, whirling vibration or the like may be generated in the rotor 1.

However, according to the above configuration, since an increase in natural frequency can be reduced by providing a clearance, a possibility of whirling vibration or the like being generated can be reduced.

In addition, according to the above-described configuration, the split ring 10 can be easily configured by sequentially installing the plurality of segmented parts (the first segmented parts 101 and the second segmented part 102) on the recessed part 11 of the rotor main body 9 from the outer circumferential side.

Figure 5:
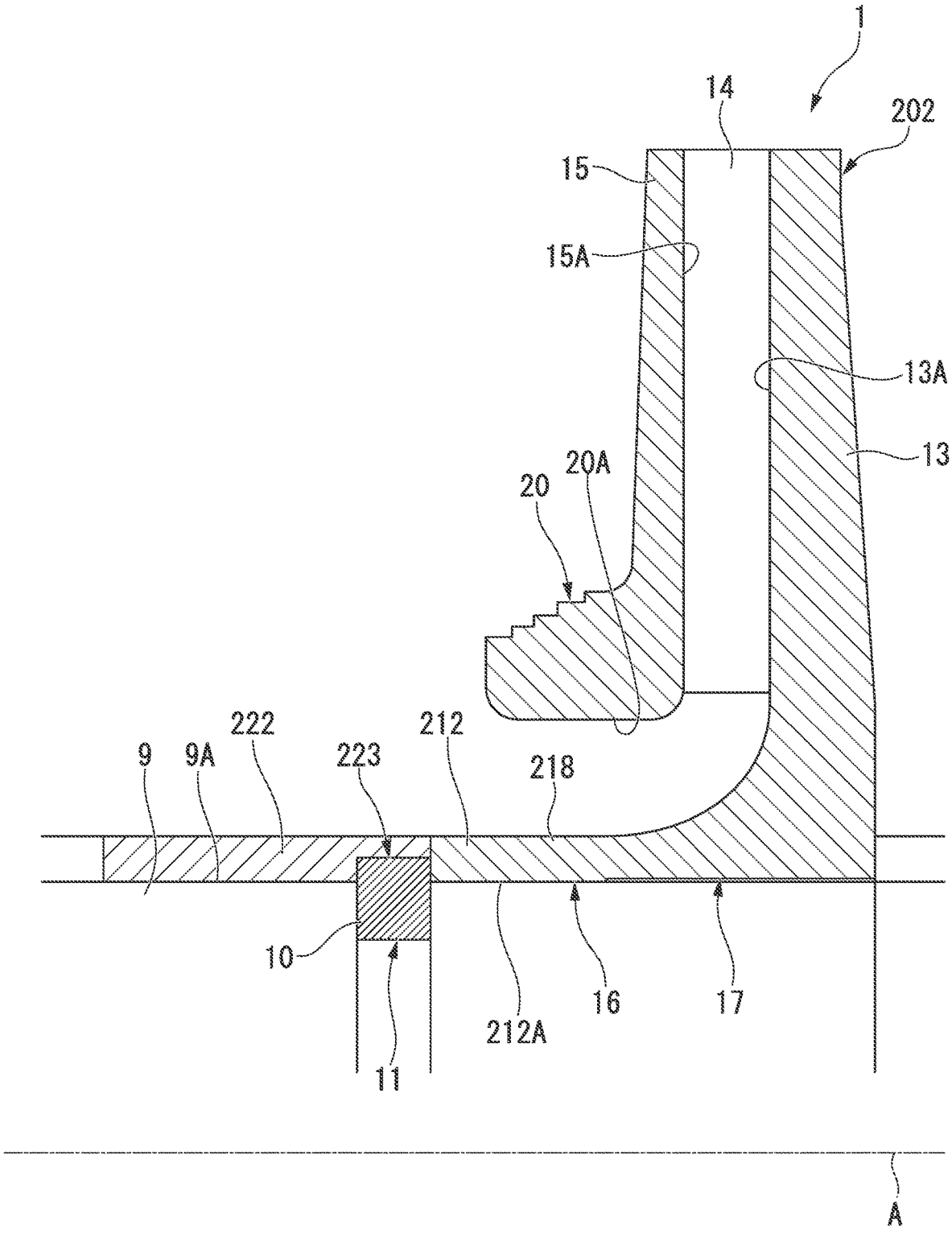
FIG. 5 is a view illustrating a configuration of a rotor according to one or more embodiments of the present invention.

Next, embodiments of the present invention will be described with reference to FIG. 5. Configuration parts the same as those in one or more embodiments described above will be denoted with the same reference signs and detailed description thereof will be omitted. As illustrated in the drawing, in one or more embodiments, a cylinder part 212 of an impeller 202 is integrally formed as one member, which is different from one or more embodiments described above. That is, in one or more embodiments, the above-described clearance C is not formed in the cylinder part 212.

Further, a fitting region 16 similar to the above is formed in a region of an inner circumferential surface 212A of this cylinder part 212 including an end part on one side in an axis A direction. A non-fitting region 17 is formed on the other side in the axis A direction of the fitting region 16.

A split ring 10 is in contact with an end surface on one side in the axis A direction of the cylinder part 212 formed as described above. As in one or more embodiments described above, a part of a radial outer side of the split ring 10 protrudes from an outer circumferential surface 9A of a rotor main body 9 to the radial outer side. A step is formed in a radial direction between an outer circumferential surface of the split ring 10 and an outer circumferential surface of the cylinder part 212 (a flow path forming surface 218).

On one side in the axis A direction of the split ring 10, a sleeve 222 formed in a cylindrical shape around the axis A is installed. An outer circumferential surface of the sleeve 222 has a substantially uniform outer diameter over the entire region in the axis A direction. On the other hand, an enlarged diameter part 223 which covers the split ring 10 from the radial outer side is formed at an end edge on the other side in the axis A direction in an inner circumferential surface of the sleeve 222. The enlarged diameter part 223 fills the step between the outer circumferential surface of the split ring 10 and the flow path forming surface 218. That is, in a state in which the sleeve 222 and the impeller 202 are installed on the rotor main body 9, the outer circumferential surface of the sleeve 222 and the flow path forming surface 218 are continuous in the axis A direction.

According to this configuration, the split ring 10 comes into contact with the end surface on one side in the axis A direction of the cylinder part 212 from one side in the axis A direction. Thereby, even when a thrust force is applied to the cylinder part 212 from the other side in the axis A direction toward the one side, the thrust force can sufficiently be resisted. Further, a size of the fitting region 16 and a magnitude of a tightening margin can be reduced to be small as compared with a case in which the split ring 10 is not provided. Thereby, a likelihood of occurrence of vibration in the centrifugal compressor 100 can be reduced.

Figure 6:
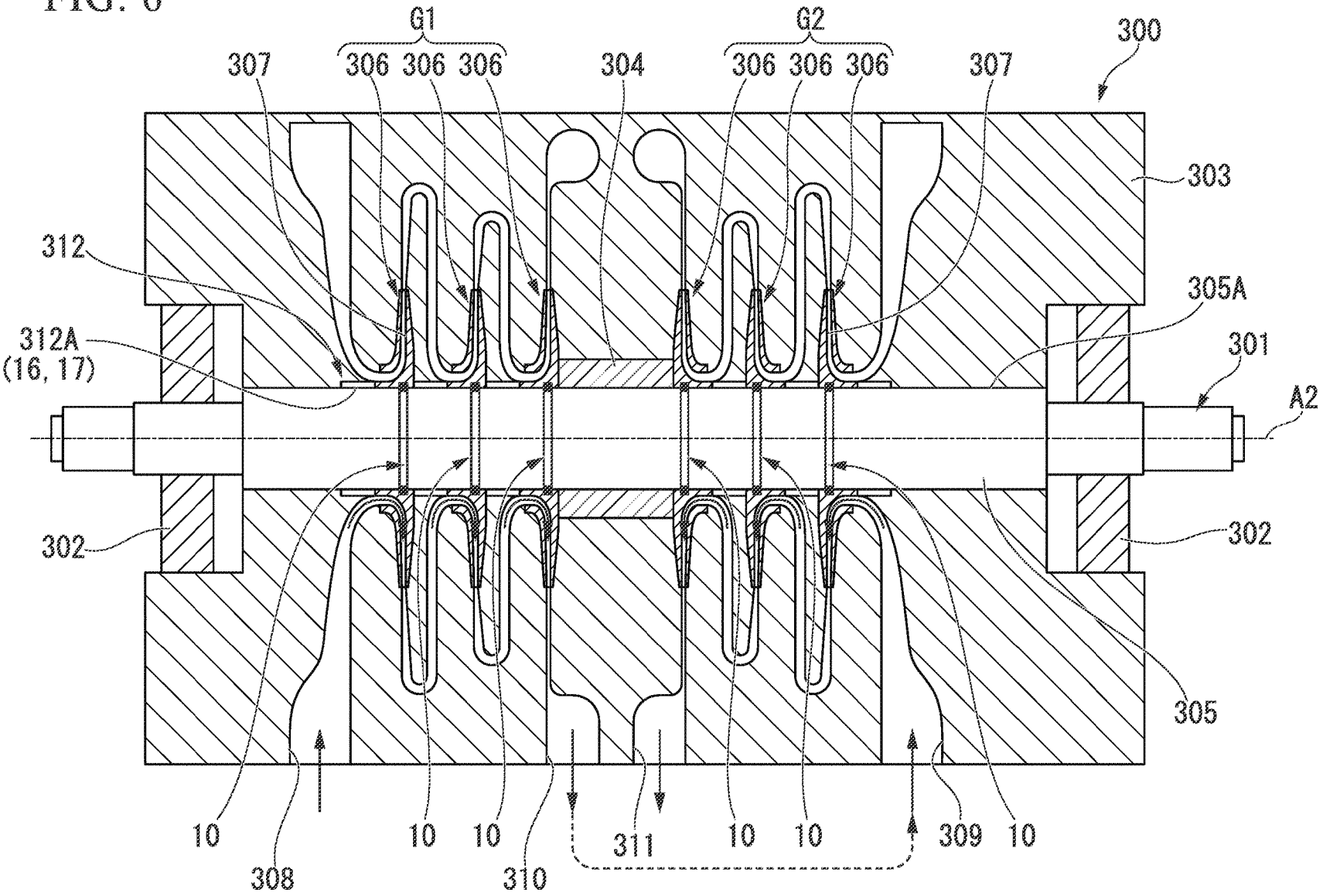
FIG. 6 is a view illustrating a configuration of a centrifugal compressor according to one or more embodiments of the present invention.

Next, embodiments of the present invention will be described with reference to FIG. 6. Configurations parts the same as those in one or more embodiments described above will be denoted with the same reference signs and detailed description thereof will be omitted. As illustrated in the drawing, a centrifugal compressor 300 according to one or more embodiments described below is a so-called back-to-back type unlike the straight type centrifugal compressor 100 in one or more embodiments described above.

The centrifugal compressor 300 includes a rotor 301 which extends around an axis A2, a pair of bearing parts 302 which rotatably support the rotor 301 around the axis A2, a casing 303 which covers these from an outer circumferential side, and a balance piston 304 installed on the casing 303.

The rotor 301 includes a substantially rod-shaped rotor main body 305, a plurality of impellers 306 provided at intervals in the axis A2 direction on this rotor main body 305, and a split ring 10 (a contact member) interposed between the rotor main body 305 and each of the impellers 306.

In one or more embodiments, six impellers 306 are installed on the rotor main body 305. Among these impellers 306, in the three impellers 306 positioned on one side in the axis A2 direction (a first impeller group G1), blades 307 extend toward one side in the axis A2 direction. On the other hand, in the three impellers 306 positioned on the other side in the axis A2 direction (a second impeller group G2), blades 307 extend toward the other side in the axis A2 direction.

All the impellers 306 are fixed to the rotor main body 305 by tight fitting. That is, a fitting region 316 and a non-fitting region 317 as in the above-described embodiments are formed between an outer circumferential surface 305A of the rotor main body 305 and an inner circumferential surface 312A of a cylinder part 312 of the impeller 306. Further, as in the above-described embodiments, the split ring 10 is installed between each of the impellers 306 and the rotor main body 305.

A first intake port 308 and a second intake port 309 for taking a fluid into the casing 303 are provided in the casing 303. Further, a first discharge port 310 and a second discharge port 311 for discharging a compressed fluid are provided in the casing 303.

A fluid introduced into the casing 303 through the first intake port 308 is compressed by the rotating first impeller group G1 to a high pressure (intermediate pressure). The fluid compressed by the first impeller group G1 is introduced into the casing 303 again by the second intake port 309 from the first discharge port 310 via a pipe (not illustrated). The fluid at the intermediate pressure introduced from the second intake port 309 is compressed again by the second impeller group G2 and reaches a higher pressure (target pressure). The fluid compressed by the second impeller group G2 is discharged outside through the second discharge port 311.

Here, a fluid having a higher pressure than that of the first impeller group G1 side is flowing on the second impeller group G2 side. Thus, there is a possibility of a fluid leaking from the second impeller group G2 side toward the first impeller group G1 side. The balance piston 304 is provided for sealing a flow of a fluid between the first impeller group G1 and the second impeller group G2.

In the centrifugal compressor 300 configured as described above, as in the centrifugal compressor 100 in the above-described embodiments, a thrust force is applied to each of the impellers 306. More specifically, a thrust force from the other side in the axis A2 direction toward one side is applied to the three impellers 306 of the first impeller group G1. A thrust force from one side in the axis A2 direction toward the other side is applied to the three impellers 306 of the second impeller group G2. However, it is possible to sufficiently resist such a thrust force by providing the above-described split ring 10. That is, also with a back-to-back type device such as the centrifugal compressor 300, by using the split ring 10, it is possible to reduce a size of the fitting region 316 and a magnitude of a tightening margin. Thereby, a likelihood of occurrence of vibration in the centrifugal compressor 300 can be reduced to be small as compared with a case in which tight fitting is applied over the entire outer circumferential surface 305A of the rotor main body 305, and the impellers 306 can be easily installed on or removed from the rotor main body 305.

Embodiments of the present invention have been described with reference to the drawings. Further, each of the above-described configurations is merely an example, and various modifications and changes can be applied thereto.

For example, the number of impellers 2 (impellers 306) provided in the centrifugal compressor 100 and the centrifugal compressor 300 illustrated in each of the above embodiments is not limited to the above, and may be arbitrarily determined according to design and specifications.

Further, in each of the above-described embodiments, an example in which a type of impeller 2 having the cover 15 (closed impeller) is employed as the impeller 2 has been described. However, the type of impeller 2 is not limited thereto, and it is also possible to employ a type not having the cover 15 (open impeller).

In addition, in each of the above embodiments, an example in which one split ring 10 is provided corresponding to one impeller 2 has been described. However, it is also possible to provide a plurality (two, or three or more) of split rings 10 for one impeller 2. According to such a configuration, a thrust force applied to the impeller 2 can be more sufficiently resisted.

In addition, in each of the above-described embodiments, an example in which the annular split ring 10 is used as the contact member has been described. However, a form of the contact member is not limited to the split ring 10. As an example, a plurality of pin-shaped members protruding toward the radial outer side may be arranged at intervals in the circumferential direction on the outer circumferential surface 9A of the rotor main body 9 to form a contact member. Also with such a configuration, the thrust force applied to the impeller 2 can be sufficiently resisted.

INDUSTRIAL APPLICABILITY

According to the above configuration, it is possible to provide a rotor of a centrifugal compressor which can be easily assembled, a method of manufacturing the same, and a centrifugal compressor which can be stably operated under a high compression ratio.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Rotor
2 Impeller
3 Flow path
4 Casing
5 Journal bearing
6 Thrust bearing
7 Intake port
8 Discharge port
9 Rotor main body
10 Split ring
11 Recessed part
12 Cylinder part
13 Annular disc
14 Blade
15 Cover
16, 316 Fitting region
17, 317 Non-fitting region
18 Flow path forming surface
19 Stepped part
20 Protruding part
21 Impeller flow path
22 Sleeve
100 Centrifugal compressor
101 First segmented part
102 Second segmented part
111 Recessed part bottom surface
112 Recessed part first end surface
113 Recessed part second end surface
121 First cylinder part
122 Second cylinder part
123 Second cylinder part end surface
161 First fitting region
162 Second fitting region
171 First non-fitting region
172 Second non-fitting region
191 First end surface
192 Bottom surface
202 Impeller
212 Cylinder part
212A Inner circumferential surface
218 Flow path forming surface
222 Sleeve
223 Enlarged diameter part
300 Centrifugal compressor
301 Rotor
302 Bearing part
303 Casing
304 Balance piston
305 Rotor main body
306 Impeller
307 Blade
308 First intake port
309 Second intake port
310 First discharge port
311 Second discharge port
9A Outer circumferential surface
12A, 12B Inner circumferential surface
13A First facing surface
15A Second facing surface
20A Cover facing surface
101A First inclined surface
102A Second inclined surface
A, A2 Axis
C Clearance
G1 First impeller group
G2 Second impeller group Although the disclosure has been described with respect to only a limited number of embodiments, those skill in the art, having benefit of this disclosure, will appreciate that various other embodiments may be devised without departing from the scope of the invention. Accordingly, the scope of the invention should be limited only by the attached claims.

The invention claimed is:

1. A rotor of a centrifugal compressor, comprising:

a rotor main body that:

extends in an axis direction, and includes a recessed part that is disposed on an outer circumferential surface of the rotor main body;

an impeller including:

a cylinder part having a cylindrical shape that:

extends around the axis direction, and includes an inner circumferential surface with a fitting region tightly fitted to the outer circumferential surface of the rotor main body;

an annular disc that extends from the cylinder part to a radial outer side with respect to the axis direction;

a plurality of blades disposed at intervals in a circumferential direction on a surface facing a first side in the axis direction of the annular disc; and a cover that covers the plurality of blades from the first side in the axis direction; and a contact member that is fitted into the recessed part and includes:

a part that protrudes toward a radial outer side from the outer circumferential surface and contacts the cylinder part from the axis direction; and a pair of first segment parts and a second segment part all arranged in the circumferential direction with respect to the axis, wherein the second segment part is surrounded on both circumferential sides by the first segment parts, a first inclined surface on a second side in the circumferential direction of each of the first segment parts extends to be inclined with respect to the radial direction with respect to its own central axis, an end surface on a first side in a circumferential direction of each of the first segment parts extends substantially parallel to a radial direction with respect to its own central axis, the second segment part is symmetrical in the circumferential direction, a second inclined surface on both circumferential sides of the second segment part obliquely extends to be inclined with respect to the radial direction with respect to its own central axis, the second inclined surface is inclined with respect to the radial direction at substantially the same angle as the first inclined surface, the first inclined surface and the second inclined surface are configured to be in contact with each other and substantially parallel to each other, and the first segment parts and the second segment part are fitted into the recessed part such that:

the first segment parts and the second segment part are elastically deformed in a direction in which a curvature of the first segment parts and the second segment part decreases, the second inclined surface of the second segment part exerts an elastic force on the first inclined surface of the first segment parts in a direction in which the curvature increases, and the first segment parts are undetachably accommodated in the recessed part while elastically deformed in the direction in which the curvature decreases.

2. The rotor of a centrifugal compressor according to claim 1, wherein:

the cylinder part includes:

a first cylinder part disposed on a first side in the axis direction; and a second cylinder part disposed on a second side of the first cylinder part in the axis direction with a clearance in the axis direction between the first cylinder, a stepped part recessed to the radial outer side is disposed in a region of the inner circumferential surface of the first cylinder part including an end part on the second side in the axis direction, an end surface on the first side in the axis direction of the stepped part comes in contact with the contact member from the first side in the axis direction, and an end surface on the first side in the axis direction of the second cylinder part comes in contact with the contact member from the second side in the axis direction, and an end part on the radial inner side of the clearance communicates with a region on the radial inner side of the stepped part.

3. The rotor of a centrifugal compressor according to claim 1, wherein the contact member comes in contact with an end surface of the cylinder part on the first side in the axis direction from the first side in the axis direction.

4. The rotor of a centrifugal compressor according to claim 1, wherein the inner circumferential surface of the cylinder part includes a non-fitting region adjacent to the fitting region in the axis direction, and has an inner diameter larger than that of the rotor main body.

5. A centrifugal compressor comprising:

the rotor according to claim 1; and a casing that covers the rotor from an outer circumferential side to form an internal flow path.

6. A method of manufacturing the rotor of the centrifugal compressor according to claim 1, comprising:

installing the cylinder part of the impeller on the rotor main body from the axis direction;

forming the fitting region on an inner circumferential surface of the cylinder part by means of tight fitting;

installing the contact member on the recessed part of the rotor main body; and fitting the first segment parts and the second segment part into the recessed part, wherein the installing of the cylinder part on the rotor main body is performed after the first segment parts and the second segment part are installed on fitted into the recessed part of the rotor main body.

7. The method of manufacturing the rotor of a centrifugal compressor according to claim 6, wherein the tight fitting is a shrink fitting.

* * * * *